US007861337B1

(12) United States Patent
Patel et al.

(10) Patent No.: US 7,861,337 B1
(45) Date of Patent: Jan. 4, 2011

(54) HAMMOCK DEVICE FOR INFANTS

(76) Inventors: Bakulesh D. Patel, 4 Rosewood Ct., Danville, PA (US) 17821; Damayanti B. Patel, 4 Rosewood Ct., Danville, PA (US) 17821

( * ) Notice: Subject to any disclaimer, the term of this patent is extended or adjusted under 35 U.S.C. 154(b) by 0 days.

(21) Appl. No.: 12/478,660

(22) Filed: Jun. 4, 2009

(51) Int. Cl.
*A47D 9/02* (2006.01)

(52) U.S. Cl. ..... 5/108; 5/109; 5/101

(58) Field of Classification Search ..... 5/120–122, 5/127, 129, 108, 109, 101
See application file for complete search history.

(56) References Cited

U.S. PATENT DOCUMENTS 3,203,012 A 8/1965 Roberts
4,375,110 A 3/1983 Murphy
4,934,997 A 6/1990 Skakas
4,996,732 A * 3/1991 Chang ..... 5/101
5,553,337 A * 9/1996 Lin ..... 5/93.2
5,715,552 A 2/1998 DeAth
5,857,231 A 1/1999 Wade
D443,431 S 6/2001 Tseng
6,386,986 B1 * 5/2002 Sonner et al. ..... 472/119
6,470,518 B1 10/2002 Ke
7,694,362 B2 * 4/2010 Gudipati ..... 5/109

* cited by examiner

*Primary Examiner*—Fredrick Conley

(57) ABSTRACT

A hammock device for cradling infants comprising a foldable support base for placing on a ground surface; a first and second support brace pivotally attached to the base; a swinging bar pivotally connected to the first support brace via a first control box and to the second support brace via a second control box; a sheet-like hammock component wherein the first end is attached near the first end of the swinging bar and the second end is attached near the second end of the swinging bar such that an inner cavity is formed in which the infant may be placed; and a motor disposed in the first control box that causes the swinging bar to rotate in a first direction and a second direction.

10 Claims, 3 Drawing Sheets

FIG. 3
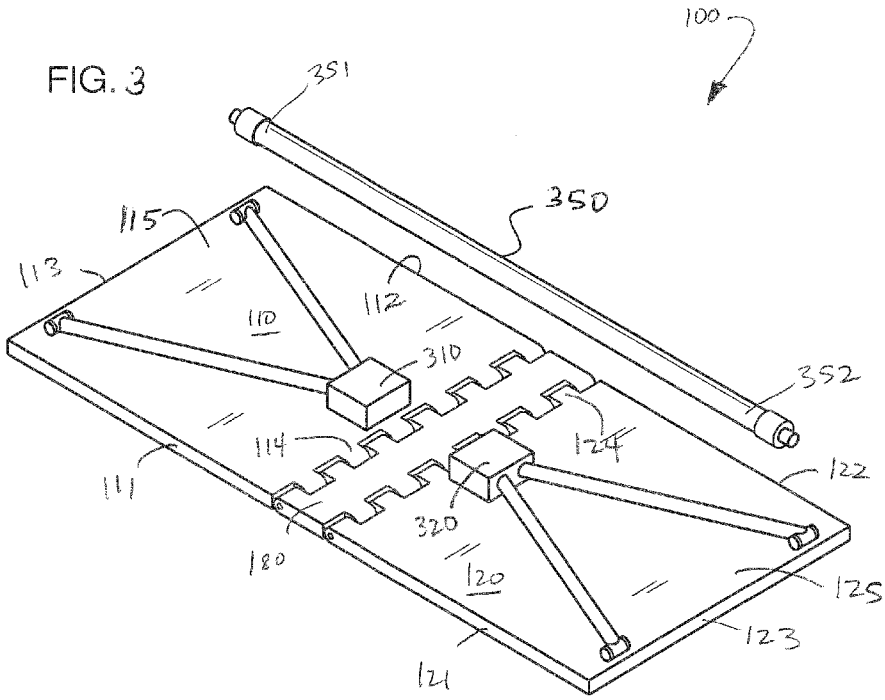
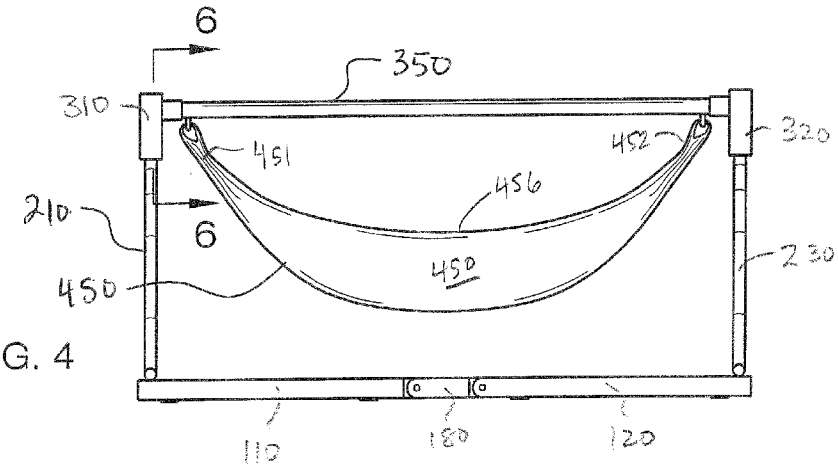
FIG. 4

HAMMOCK DEVICE FOR INFANTS

FIELD OF THE INVENTION

The present invention is directed to a hammock for infants. More particularly, the present invention is directed to a mechanical swinging hammock having a support base that can be folded for storage or transport.

BACKGROUND OF THE INVENTION

Infants generally like to be covered and cradled, however covering an infant in some cases may lead to suffocation. The present invention features a hammock device for cradling an infant. The hammock device does not cover the infants face, which may help prevent suffocation. The hammock device may comprise a motor for swinging the hammock device back and forth.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 3 is a perspective view of the base of the hammock device of the present invention, wherein the base is in the unfolded position.

FIG. 4 is a front view of the hammock device of the present invention.

DESCRIPTION OF PREFERRED EMBODIMENTS

Figure 1:
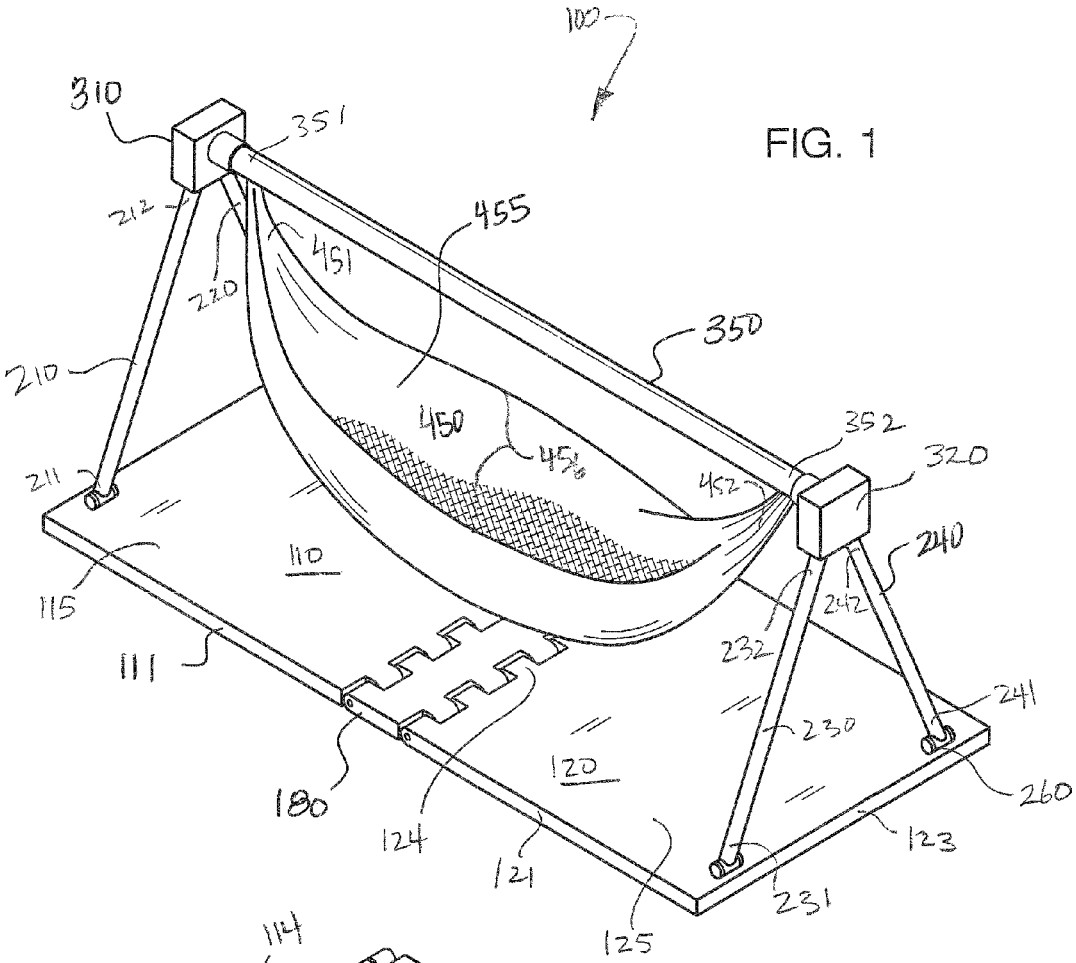
FIG. 1 is a perspective view of the hammock device of the present invention.

The following is a listing of numbers corresponding to a particular element refer to herein:

100 hammock device
110 first panel
111 first side of first panel
112 second side of first panel
113 third side of first panel
114 fourth side of first panel
115 top surface of first panel
116 bottom surface of first panel
120 second panel
121 first side of second panel
122 second side of first panel
123 third side of first panel
124 fourth side of first panel
125 top surface of first panel
126 bottom surface of first panel
180 base panel
181 first hinge
182 second hinge

210 first support pole
211 first end of first support pole
212 second end of first support pole
220 second support pole
221 first end of second support pole
222 second end of second support pole
230 third support pole
231 first end of third support pole
232 second end of third support pole
240 fourth support pole
241 first end of fourth support pole
242 second end of fourth support pole
260 pivoting means
310 first control box
315 on/off button
316 timer button
317 speed control button
318 power cord
320 second control box
350 swinging bar
351 first end of swinging bar
352 second end of swinging bar
450 hammock component
451 first end of hammock component
452 second end of hammock component
455 inner cavity of hammock component
456 outer perimeter of hammock component
510 foot pad
550 motor Referring now to FIGS. 1-6, the present invention features a hammock device 100 for cradling infants. The hammock device 100 comprises a generally flat foldable support base for placing on a ground surface. The foldable support base comprises a first panel 110 and a second panel 120. The first panel 110 has a first side 111, second side 112, third side 113, fourth side 114, top surface 115, and bottom surface 116. The second panel 120 has a first side 121, second side 122, third side 123, fourth side 124, top surface 125, and bottom surface 126.

The first panel 110 is connected to the second panel 120. In some embodiments, the fourth side 114 of the first panel 110 is pivotally connected to the fourth side 124 of the second panel 120. In some embodiments, the panels are connected via a base panel 180. A first hinge 181 pivotally connects the first panel 110 to the base panel 180 and a second hinge 182 connects the second panel 120 to the base panel 180. The base panel 180 allows the first panel 110 to be folded onto the second panel 120 such that the top surface 115 of the first panel 110 faces the top surface 125 of the second panel 120 (see FIG. 2). The first panel 110 and second panel 120 are separated by a space (see FIG. 2).

The hammock device 100 further comprises a first support brace and a second support brace. In some embodiments, the first support brace is placed at or near a first outer edge of the base and the second support brace is disposed at or near a second outer edge opposite the first outer edge of the base. The first support brace and second support brace support a swinging bar 350. The first support brace and second support brace are generally parallel to each other and generally perpendicular to the base. The swinging bar 350 is generally perpendicular to the support braces and generally parallel to the base.

In some embodiments, the first support brace comprises a first support pole 210 having a first end 211 and a second end 212 and a second support pole 220 having a first end 221 and a second end 222. In some embodiments, the second end 212 of the first support pole 210 and the second end 222 of the second support pole 220 intersect while the first end 211 of the first support pole 210 and the first end 221 of the second support pole 220 extend outwardly away from each other, attaching to corners of the base.

In some embodiments, the second support brace comprises a third support pole 230 having a first end 231 and a second end 232 and a fourth support pole 240 having a first end 241 and a second end 242. In some embodiments, the second end 232 of the third, support pole 230 and the second end 242 of the fourth support pole 240 intersect while the first end 231 of the third support pole 241 and the first end 221 of the fourth support pole 240 extend outwardly away from each other, attaching to corners of the base.

Figure 2:
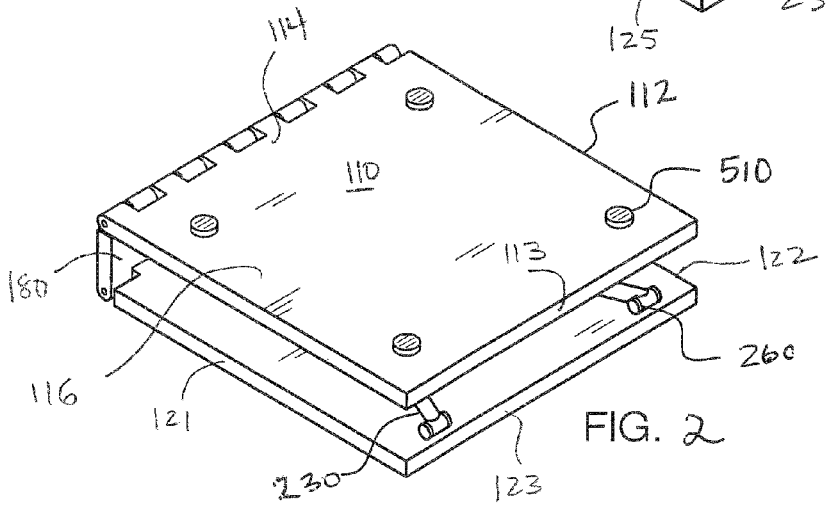
FIG. 2 is a perspective view of the base of the hammock device of the present invention, wherein the base is in the folded position.
Figure 5:
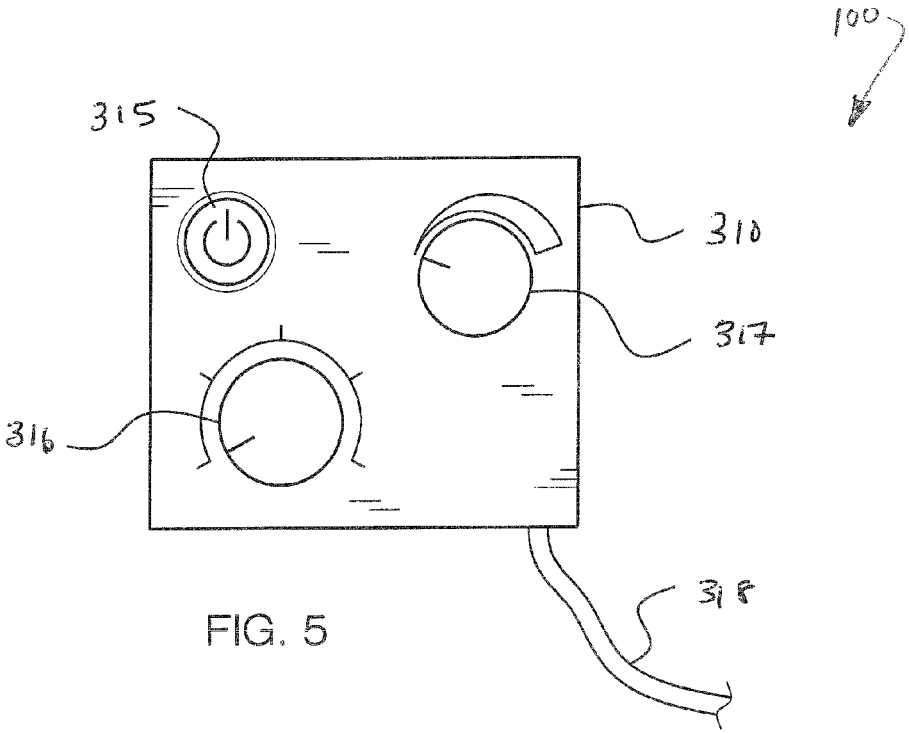
FIG. 5 is a front view of the control box of the hammock device of the present invention.

In some embodiments, the first end 211 of the first support pole 210 and/or the first end 221 of the second support pole 220 and/or the first end 321 of the third support pole 230 and/or the first end 241 of the fourth support pole 240 are pivotally attached to the base via a pivoting means 260. The pivoting means may allow the hammock device 100 to be folded for storage. For example, as shown in FIG. 2 and FIG. 3, the first support brace and the second support brace may be pivoted such that they are flush with the first panel 110 and second panel 120, respectively, of the base. With the support braces folded down, the base can be folded on itself for a more compact configuration. The space between the first panel 110 and the second panel 120 allow room for the first support brace and second support brace when folded.

In some embodiments, a first control box 310 connects the first end 351 of the swinging bar 350 to the first support brace. In some embodiments, a second control box 320 connects the second end 352 of the swinging bar 350 to the second support brace. The swinging bar 350 is connected to the control boxes such that the swinging bar 350 can rotate in a first direction and a second direction. The swinging bar 350 may be detached from the control boxes or support braces so that the hammock device 100 can be folded for storage.

The hammock device 100 further comprises a sheet-like hammock component 450 for supporting the infant's body. The hammock component 450 has a first end 451, a second end 452, and an outer perimeter 456. The first end 451 of the hammock component 450 is attached at or near the first end 351 of the swinging bar 350 and the second end 452 of the hammock component 450 is attached at or near the second end 352 of the swinging bar 350, creating an inner cavity 455 in which the infant may be placed.

In some embodiments, the hammock component 450 is constructed from a material that can be molded and shaped to contour the infant's body. In some embodiments, the hammock component 450 is constructed from a blanket that can be used to treat jaundice, for example a phototherapy blanket comprising bili lights. Such blankets and phototherapies are well known to one of ordinary skill in the art.

In some embodiments, snaps are disposed on or around the outer perimeter 456 of the hammock component 450. The snaps may allow a blanket to be attached to the hammock component 450. In some embodiments, foot pads 510 are disposed on the bottom surface 116 of the first panel 110 and/or the bottom surface 126 of the second panel 120. The foot pads 510 can help to stabilize the hammock device 100 (e.g., the base) and help prevent it from slipping or moving on a the ground or floor surface.

A motor 550 is disposed in the first control box 310 that causes the swinging bar 350 to rotate in the first direction and the second direction. This motion causes the hammock component 450 to be swung back and forth.

The motor 550 is operatively connected to one or more control buttons. The control buttons may include an on/off button 315, a timer button 316, and/or a speed control button 317. In some embodiments, the on/off button 315 is for turning the motor 550 on and off, the speed control button 317 is for controlling the speed that the motor 550 rotates the swinging bar 350, and the timer button 316 is for controlling the amount of time that the motor 550 is turned on (see FIG. 5).

In some embodiments, the control button can move between a first position and a second position. In the first position, the control button causes the motor 550 to rotate the swinging bar 350. In the second position, the control button causes the motor 550 to turn off. In some embodiments, the control button is mounted on the first control box 310 or the second control box 320.

The motor 550 is operatively connected to a power source. The power source may be a battery or an electrical outlet. In some embodiments, the hammock device 100 comprises a power cord 318 for plugging into the electrical outlet.

Figure 6:
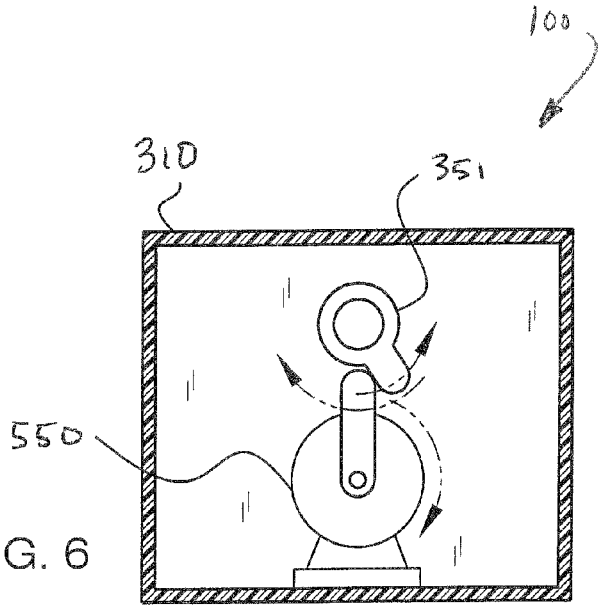
FIG. 6 is a front and cross sectional view of the control box of the hammock device of the present invention.

In some embodiments, a tab is disposed on the first end 351 of the swinging bar 350 that engages the motor 550 in the first control box 310 (see FIG. 6). The motor 550 forces the tab in a first direction and a second direction, which causes the swinging bar 350 to rotate.

In some embodiments, the hammock device 100 comprises a means of playing music, for example a MP3 player.

As used herein, the term "about" refers to plus or minus 10% of the referenced number. For example, an embodiment wherein the base is about 5 feet in length includes a base that is between 4.5 and 5.5 feet in length.

The hammock device 100 of the present invention may be constructed in a variety of sizes. For example, in some embodiments, the base is between about 3 to 5 feet in length as measured from the third edge 113 of the first panel 110 to the third edge 123 of the second panel 120. In some embodiments, the base is between about 5 to 7 feet in length as measured from the third edge 113 of the first panel 110 to the third edge 123 of the second panel 120. In some embodiments, the base is more than about 7 feet in length.

In some embodiments, the first panel 110 and/or second panel 120 is between about 2 to 3 feet in width as measured from the first end 111 to the second end 112. In some embodiments, the first panel 110 and/or second panel 120 is between about 3 to 5 feet in width as measured from the first end 111 to the second end 112. In some embodiments, the first panel and/or second panel is more than about 5 feet in width.

The following the disclosures of the following U.S. Patents are incorporated in their entirety by reference herein: U.S. Pat. No. 3,203,012; U.S. Pat. No. 6,470,518 B1; U.S. Pat. No. 4,375,110; U.S. Pat. No. 5,715,552; U.S. Pat. No. 5,857,231; U.S. Pat. No. 4,934,997.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A hammock device for cradling infants, said hammock device comprising:

(a) a foldable support base for placing on a ground surface;

(b) a first support brace pivotally attached to the base near a first outer edge of the base and a second support brace pivotally attached to the base near a second outer edge of the base opposite the first outer edge;

(c) a swinging bar having a first end and a second end, wherein the first end is pivotally connected to the first support brace via a first control box and the second end is pivotally connected to the second support brace via a second control box;

(d) a hammock component having a first end and a second end, wherein the first end is attached near the first end of the swinging bar and the second end is attached near the second end of the swinging bar such that an inner cavity is formed in which the infant may be placed; and (e) a motor disposed in the first control box that causes the swinging bar to rotate in a first direction and a second direction; wherein the motor is operatively connected to a control button and to a power source; wherein the control button can move between a first position causing the motor to rotate the swinging bar and a second position causes the motor to turn off.

2. The hammock device of claim 1, wherein the foldable support base comprises a first panel connected to a second panel via a base panel.

3. The hammock device of claim 2, wherein the first panel is pivotally connected to the base panel via a first hinge and the second panel is pivotally connected to the base panel via a second hinge, wherein the base panel provides space between the first panel and second panel when folded.

4. The hammock device of claim 1, wherein the first support brace comprises a first support pole and a second support pole, wherein first end of both support poles intersect and second ends extend outwardly away from each other and attach, to corners of the base.

5. The hammock device of claim 1, wherein the second support brace comprises a third support pole and a fourth support pole, wherein first end of both support poles intersect and second ends extend outwardly away from each other and attach to corners of the base.

6. The hammock device of claim 1, wherein snaps are disposed on or around an outer perimeter of the hammock component for attaching a blanket.

7. The hammock device of claim 1, wherein one or more foot pads are disposed on a bottom surface of the base to help stabilize the hammock device.

8. The hammock device of claim 1, wherein thee power source includes a battery or an electrical outlet.

9. The hammock device of claim 1, wherein a tab is disposed on a first end of the swinging bar that engages the motor a in the first control box.

10. The hammock device of claim 1, wherein the control button is mounted on the first control box.

* * * * *